United States Patent [19]

Szczupak

[11] Patent Number: 4,779,423

[45] Date of Patent: Oct. 25, 1988

[54] VARIABLE AREA TURBOCHARGER TURBINE AND CONTROL SYSTEM THEREFOR

[75] Inventor: David T. Szczupak, Huddersfield, England

[73] Assignee: Holset Engineering Company Limited, Turnbridge, England

[21] Appl. No.: 935,115

[22] Filed: Nov. 26, 1986

Related U.S. Application Data

[63] Continuation of Ser. No. 649,795, Sep. 12, 1984, abandoned.

[30] Foreign Application Priority Data

Sep. 20, 1983 [GB] United Kingdom ..... 8325166

[51] Int. Cl.[4] ..... F02B 37/12

[52] U.S. Cl. ..... 60/602

[58] Field of Search ..... 60/600, 601, 602, 603; 415/36, 158

[56] References Cited

U.S. PATENT DOCUMENTS

| | | | |
|---|---|---|---|
| 2,861,774 | 11/1958 | Buchi | 60/602 X |
| 3,149,820 | 9/1964 | Maio | 253/52 |
| 3,817,651 | 6/1974 | Law et al. | 415/36 X |
| 4,075,849 | 2/1978 | Richardson | 60/602 |
| 4,077,738 | 3/1978 | Keely et al. | 415/36 |
| 4,291,535 | 9/1981 | Goloff | 60/602 |
| 4,292,806 | 10/1981 | Moore et al. | 60/600 |
| 4,292,807 | 10/1981 | Rannenberg | 60/601 |
| 4,475,865 | 10/1984 | Sugishita | 415/36 |
| 4,477,875 | 10/1984 | Suzuki et al. | 60/603 X |
| 4,499,732 | 2/1985 | Szczupak et al. | 60/602 |

FOREIGN PATENT DOCUMENTS

| | | | |
|---|---|---|---|
| 862954 | 3/1941 | France . | |
| 0119945 | 7/1983 | Japan | 60/602 |
| 58-79622 | 8/1983 | Japan . | |
| 213243 | 6/1925 | United Kingdom . | |
| 691144 | 5/1953 | United Kingdom . | |
| 2083135A | 3/1982 | United Kingdom | 60/600 |

*Primary Examiner*—Michael Koczo

*Attorney, Agent, or Firm*—Gary M. Gron; Robert T. Ruff; Alan R. Loudermilk

[57] ABSTRACT

A turbocharger is provided with a system for varying the effective area of the turbine, as a predetermined function of engine rpm. The function comprises a maximum area first portion (I) at high rpms, a second minimum area portion (II) at lower rpms and an intermediate third portion (III). The third portion has a characteristic that the effective turbine area increases as a direct function of engine rpm preestablished to optimize selected operating parameters. A feedback device generates a signal representing the actual effective area and supplies it to a controller. The controller is responsive to the feedback signal to generate pressure pulses applied to a pressure responsive turbine area actuator for varying the effective area of the turbine.

7 Claims, 3 Drawing Sheets

VARIABLE AREA TURBOCHARGER TURBINE AND CONTROL SYSTEM THEREFOR

This application is a continuation of application Ser. No. 649,795, filed Sept. 12, 1984, now abandoned.

DESCRIPTION

The present invention relates to a variable area turbine and more specifically to a control system therefor, such a turbine being used in an internal combustion engine, for example.

Turbochargers are used extensively in modern diesel engines to improve fuel economy and minimize noxious emissions. Such a turbocharger comprises a turbine wheel in a chamber within a turbine housing, a compressor wheel and housing, and a central cast bearing housing between the wheels. The turbine wheel rotates when driven by exhaust gases from an internal combustion engine and causes the compressor wheel to which it is coupled to rotate and compress air, to be supplied to the engine, at a rate that is greater than the rate the engine can naturally aspirate. The turbocharger pressure output is a function of component efficiencies, mass flow through the turbine and compressor and the pressure drop across the turbine.

One problem that occurs with turbochargers is that acceleration of an engine from a relatively low rpm is accompanied by a noticeable lag in the pressure increase from the turbocharger resulting in a noticeable lag in acceleration. The reason for this is that the inlet area of the turbine is designed for maximum rated conditions. As a result, the velocity of the gases passing across the turbine wheel at low engine rpm allow the turbocharger rpm to drop to such a low level that a substantial increase in gas velocity is required to increase the turbocharger rpm.

In order to overcome this deficiency, a number of schemes have been proposed to provide the turbocharger with a variable inlet area so that at low engine rpm the area may be made small to increase the velocity of the exhaust gases entering the turbine chamber and maintain the turbocharger at a sufficiently high rpm to minimize lag. Such schemes for varying the effective inlet area of the turbine are commonly referred to as variable geometry schemes or arrangements.

Various schemes have been proposed to eliminate or reduce "turbo lag" by incorporating variable geometry into the turbine element of the turbocharger. For example D. FLAXINGTON and D. T. SZCZUPAK (1982) in their paper *Variable Area Inflow Turbine,* Proceedings of the Conference on Turbo charging and Turbo chargers Apr. 26 and 28, 1982—Institution of Mechanical Engineers, pages 55 to 62, discuss various methods of controlling turbine effective area, the most common of which are compressor boost control systems which manipulate turbine effective area to attempt to maintain a pre-set compressor pressure output. While this type gives effective transient response, it will not necessarily give the turbine effective area at higher engine rpm that produces most efficient operation.

In order to improve the efficiency, it is proposed by FLAXINGTON and SZCZUPAK to control turbine effective area approximately proportional to engine rpm. However, this suggestion does not fully define those elements of the control scheme that truly provide optimum control.

In accordance with the present invention the above problems are solved in the environment of an internal combustion engine having a turbosupercharger including a compressor and a turbine and an improved means for varying the effective area of the turbine. The improved means comprises means for actuating said means for varying the effective area as a predetermined function, said function comprising a first portion at high engine rpms beginning at and adjacent maximum engine power and extending toward the maximum engine operating rpm, said first portion maintaining its maximum area condition as established by peak engine operating pressures, a second portion at lower engine rpms beginning adjacent or below peak engine torque and extending toward the minimum engine operating rpm, said second portion maintaining the effective area substantially in the minimum area condition and a third portion intermediate the first and second portions and having as a characteristic that the effective area increases as an increasing function of engine rpm ; means for generating a feedback signal representing the actual effective area and feeding said signal back to control means, said control means being responsive to the feedback signal to generate signals applied to said actuating means to correct the means for varying the effective area of the turbine to achieve said effective area solely as a predetermined function of engine rpm.

The above and other related objects and features of the present invention will be apparent from a reading of the description of the attached drawings and the novelty thereof pointed out in the appended claims.

Figure 1:
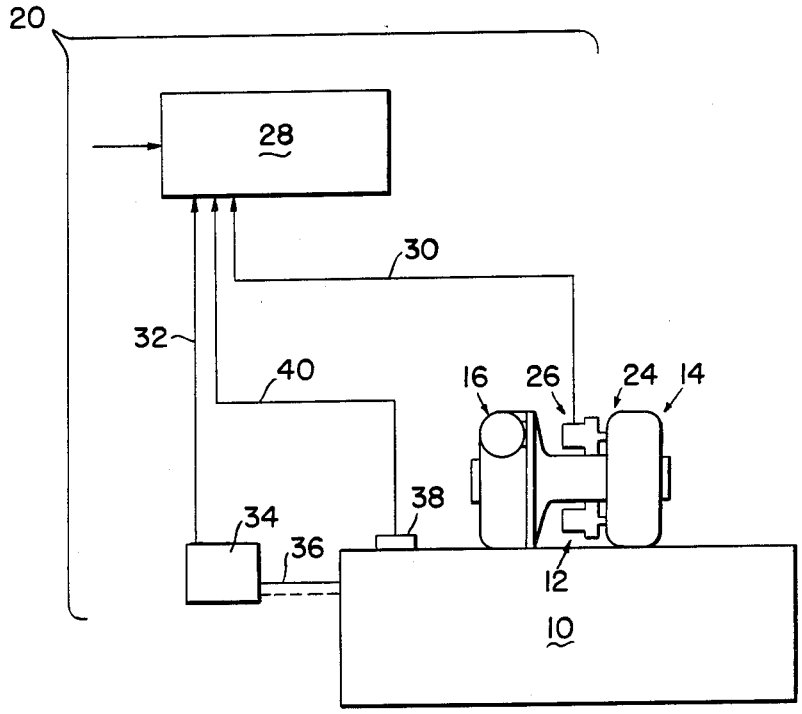
FIG. 1 is a diagrammatic representation of a turbocharged engine with a variable area turbine control system that embodies the present invention.

Referring now to FIG. 1, an internal combustion engine 10 is fitted with a turbosupercharger (turbocharger) 12. The turbocharger 12 comprises a turbine portion 14 which receives exhaust gases from the engine 10 and extracts a portion of the energy in the exhaust stream to drive a compressor portion 16 which compresses ambient air and delivers it to the engine so that the engine can produce more power and generally operate more efficiently. In order to focus on the present invention, certain details of the type of engine and engine/turbocharger interconnection have been omitted. However, persons skilled in the art should realize that suitable manifolds will be provided between the various portions of the turbocharger and the engine cylinders. Furthermore the engine may be either a spark ignition or compression ignition (diesel) type.

In order to achieve greater engine operating flexibility and efficiency, the turbine portion 14 has a variable effective area, an example of which will be described below. The exact form of the mechanism may be selected from any one of a number of variable geometry schemes set out in the previously mentioned FLAXINGTON and SZCZUPAK paper and still achieve the benefits of the present invention.

Figure 2:
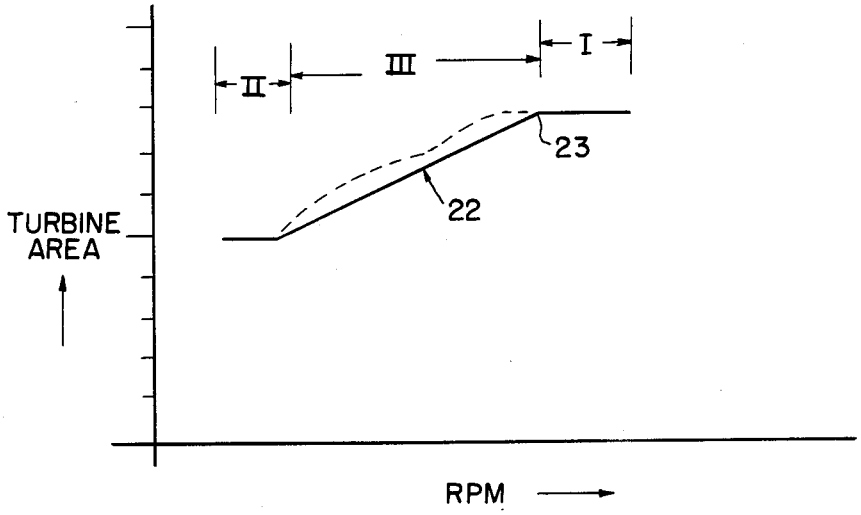
FIG. 2 illustrates the functional relationship between the turbine area and engine rpm for the control system of Figure 1.

In the present invention, a control system 20 varies the effective area of the turbine portion 14 so that it is a predetermined function, exemplified by the graph in FIG. 2. In FIG. 2, the effective area is displayed along the vertical axis and the engine rpm is displayed along the horizontal axis. The curve 22 includes a first portion I which begins at or approximate to the maximum power condition of the engine 10 and extends toward the maximum engine operating rpm. The magnitude of the area in this portion is generally constant and is established by the maximum permissible cylinder working pressure. This portion of the curve is generally constant because the need for reduced swallowing capacity does not occur until the break point 23 of the curve is reached.

The second portion II of the curve 22 occurs at a lower engine rpm beginning at or approximately the condition of maximum torque and extending toward the minimum engine operating rpm. It has been found that the area maintained in portion II is substantially reduced from the area in portion I and preferably is a reduction of approximately sixty percent. Any reduction significantly beyond sixty percent will result in pumping losses across the obstructed area that offset any gains to be realized by an increase in compressor boost. The third portion III between I and II defines an effective area that increases as a function of engine rpm. This function of engine rpm may be modified to optimize any one or combination of a number of engine operating parameters such as maximum cylinder operating pressures, cylinder temperatures, exhaust temperature, or emissions e.g. smoke. If the variable effective area device is chosen to be a turbine inlet nozzle as mentioned below, it is preferable that the turbine inlet nozzle be varied as an approximate linear function of engine rpm in portion III. However, other relationships may be employed as illustrated by the dashed line in FIG. 2 including quartic equations established by using predetermined points in portion III.

The above relationships have been found to result in the best compromise between transient engine response, i.e. rapid increase in manifold boost during acceleration and the nozzle area which gives optimum fuel efficiency at high engine rpm.

In order to achieve the control function set out above, the control system 20 comprises a varaible area nozzle assembly 24 actuated by one or more actuating devices 26 energized by controller 28 via line 30. The controller 28 generates appropriate control signals to energize the variable area system in such a way that the curve of FIG. 2 is realized using a primary independent variable input from a line 32 connected to an rpm signal generating device 34 mechanically or electronically connected to engine 10 via connection 36 to generate a signal directly proportional to engine rpm.

The controller 28 may be analog or digital depending on the particular system needs and the actuating device 26 may take a number of forms illustrated in succeeding paragraphs. The actuating device may be an electrically energized stepper motor which has the capability of generating an inherent feedback signal to the controller 28 so that the nozzle area is corrected to maintain the predetermined schedule of FIG. 2. The controller may be configured to follow the curve of FIG. 2 by a mathematical computation procedure or by a look-up table procedure.

Additional control functions may be employed in the system 20 to temporarily maintain the inlet nozzle assembly 24 in a specified operating condition. For example, a signal generating device or switch 38 is responsive to engine coolant temperature and communicates with controller 28 via line 40 to maintain the inlet nozzle assembly 24 in a minimum area condition preferably for a predetermined relatively short period of time, whenever the engine is below a certain temperature representing cold operating conditions to minimize and preferably eliminate white smoke emissions if engine 10 is a diesel. It should be noted that the minimum area position is not mandated after the time period to avoid the occurence of engine cylinder over boost.

Figure 3:
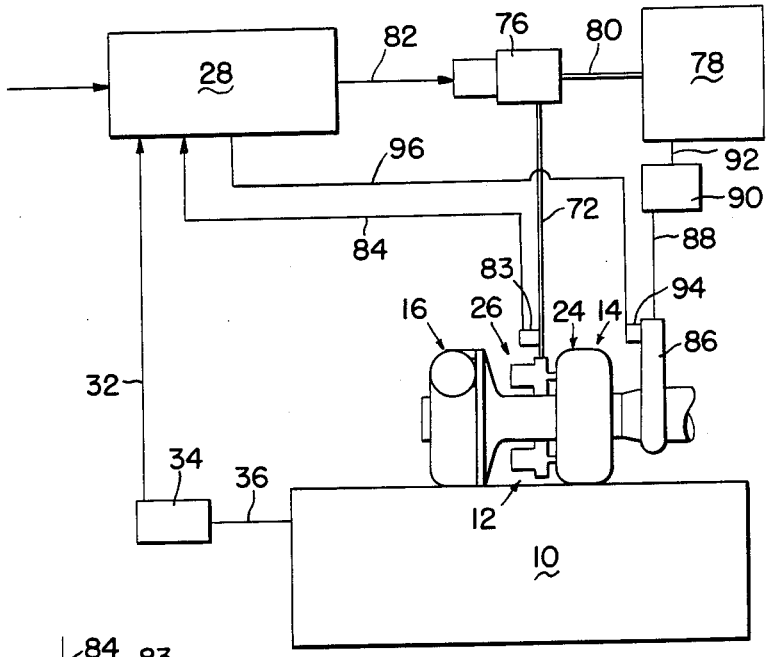
FIG. 3 shows one embodiment of the control system of FIG. 1 which employs fluid pressure to vary the area of the turbine.
Figure 4:
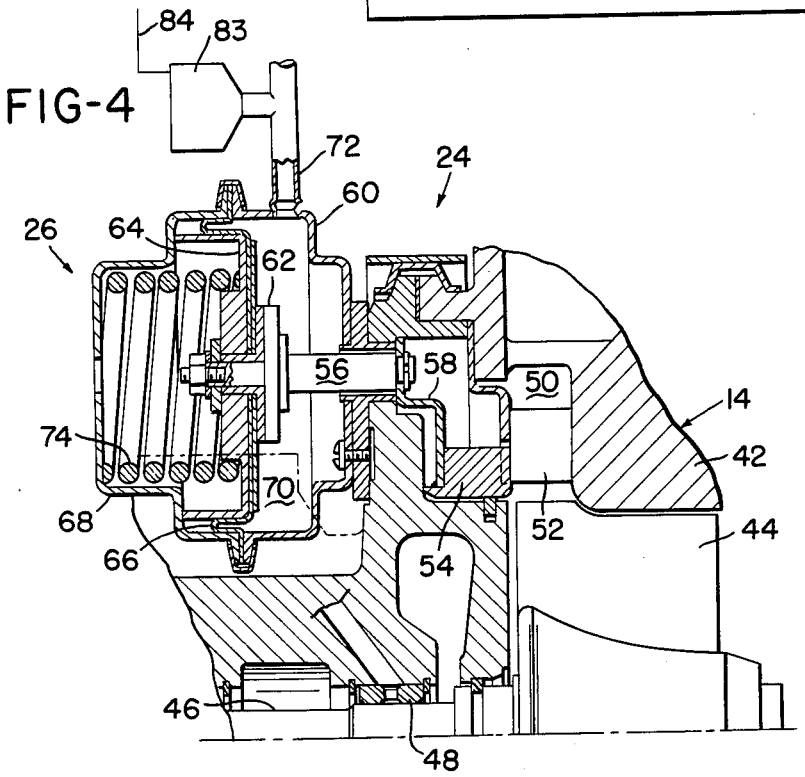
FIG. 4 is a sectional view of part of the turbine portion of the turbocharger, and of the actuator assembly for the control system of FIG. 3.

The discussion below will show alternative systems and where possible, like numbers will be used to indicate generally like components. Referring to FIGS. 3 and 4, the turbine portion 14 comprises a housing 42 which contains a rotatable centripetal turbine wheel 44 mounted on a shaft 46 which is journalled in bearing assembly 48 and connected to the compressor 16 (not shown in FIG. 4). Exhaust gases are admitted to the wheel 44 past an annular nozzle passage 50 having a plurality of vanes 52 which direct gases flowing inward in the appropriate tangential direction. The flow area of the nozzle passage 50 is varied by an annular control ring 54 which is slotted to embrace vanes 52 and to variably obstruct nozzle passage 50. The control ring 54 is translatable into and out of nozzle passage 50 by an output shaft 56 of the actuator assembly 26, by means of a flange 58. The actuator assembly 26 comprises a first formed housing 60 fixed to the turbine and through which shaft 56 extends to flanges 62, 64 which sandwich a diaphragm 66. Diaphragm 66 has its outer perimeter sandwiched between housing 60 and a second housing 68, suitably fixed to one another. Diaphragm 66 and housing 60 define a variable volume chamber 70 which is pressurized through line 72 to a controlled level. A spring 74 in housing 68 acts on diaphragm 66 in opposition to the force generated on it by the pressure in chamber 70. The spring 74, as illustrated in FIG. 4, may have a force versus displacement characteristic such that the pressure in chamber 70 is directly proportional to the displacement of shaft 56, and therefore the area of nozzle passage 50.

The pressure in chamber 70 is controlled by a solenoid valve 76 (FIG. 3) connected to a pressurized fluid (such as air) tank 78 by a line 80. Solenoid valve 76 may be of the type that is a pressure regulating valve in response to electrical signals from controller 28 via line 82 or maybe an on/off valve.

The valve 76 is adapted to admit controlled shots of pressurized air from tank 78 to maintain the appropriate pressure in chamber 70. In order to permit controlled reduction of pressure in chamber 70, it is continuously bled, for example, by providing a clearance between shaft 56 and housing 60.

Controller 28 sends to solenoid valve 76 electrical pulses of appropriate duration in response to the predetermined schedule established according to FIG. 2 and the independent control inputs provided by rpm signal generator 34. In order to provide a feedback function for this system, a pressure sensor 83 is connected so as to sense the pressure in chamber 70 and supply an electrical signal via line 84 to controller 28. As noted above, the pressure in chamber 70 bears a directly proportional relationship to the area of nozzle passage 50 making the pressure signal a convenient signal to feedback the actual nozzle area to controller 28.

An example of a suitable controller 28 can be an analog controller operating on a comparison of dc voltages, one of which is from an analog-to-digital converter receiving a signal from a magnetic pickup transducer 34 and modified to produce the schedule of FIG. 2. The other voltage is generated by the pressure sensor 83. The resultant error signal is converted into a series of variable width electrical pulses which are applied to solenoid valve 76. Solenoid valve 76 opens and closes to control pressure in chamber 70 and thus the flow area of nozzle passage 50.

There are some circumstances under which it is desired to include an additional control function for the system of FIGS. 3 and 4. When diesel engines are used for vehicular power, it may be required that an engine exhaust brake be provided at the output from the turbine 14 to selectively obstruct exhaust flow from the engine 10, thus giving it a retarding capability which slows down a vehicle. For example guillotine type exhaust brake 86 is illustrated and it receives a pressure actuating signal from line 88 and control valve 90 which selectively connects pressurized fluid in tank 78 through line 92, control valve 90 and line 88 to the brake 86 to block flow from turbine 14.

When valve 90 blocks flow, the air being compressed by the engine heats up significantly and may elevate temperatures around the turbine to the point where it may be harmful to the diaphragm 66 which is usually made from elastomeric material. In order to alleviate this condition, a suitable condition sensor 94 (for example a valve position sensor) located on the brake 86 sends a signal via line 96 to controller 28 when valve 90 is blocking flow. This causes valve 76 to be selectively maintained in a position that permits pressurized fluid to be delivered to chamber 70 and bleed out past shaft 56 thereby cooling diaphragm 66. As a result, heated pressurized air in the nozzle passage 50 is prevented from entering chamber 70.

Figure 5:
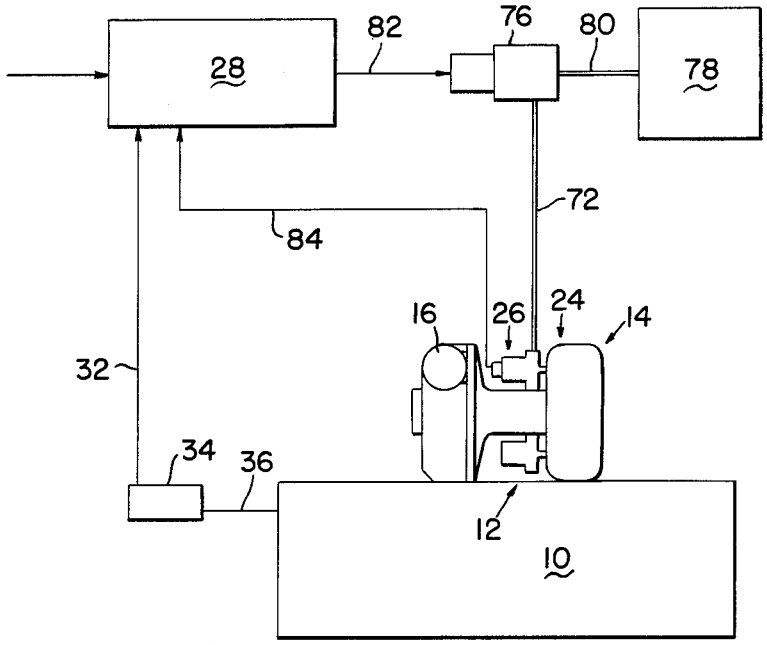
FIG. 5 shows another embodiment of the control system of FIG. 1 which also employs fluid pressure to vary the area of the turbine.
Figure 6:
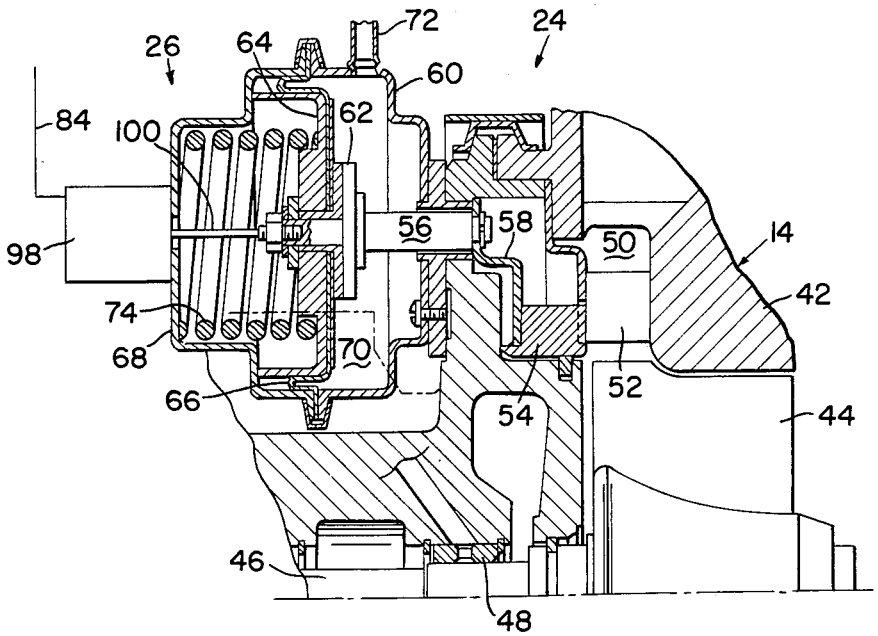
FIG. 6 is a sectional view of part of the turbine portion of the turbocharger and of the actuator assembly for the control system of FIG. 5.

The control system of FIGS. 3 and 4 utilizes a feedback signal which is an inferred nozzle area signal by means of pressure transducer 83. It may be desirable in some cases to use a signal that represents actual movement of shaft 56 and thus the flow area of nozzle passage 50. The control system of FIGS. 5 and 6 does this by incorporating on housing 68 a displacement transducer 98 which has a rod 100 fixed to the end of shaft 56. Transducer 98 generates a signal and sends it to the controller 28 through line 84 to appropriately correct the control signal from controller 28. The advantage of this type of signal is that it can detect when the control ring 58 is prevented from moving thereby permitting the incorporation in the controller of a warning signal device.

While a preferred embodiment of the present invention has been described, it should be apparent to those skilled in the art that it may be practiced in other forms without departing from the spirit and scope thereof.

Having thus described the invention, what is novel and desired to be secured by Letters Patent of the United States is:

1. In an internal combustion engine having a turbosupercharger including a compressor and a turbine and a means for varying the effective area of the turbine, a control system comprising, an actuator for actuating said means for varying the effective area of the turbine, said actuator being responsive to fluid pressure;

a control means connected to a source of fluid pressure generating a fluid pressure signal for energizing said actuator as a predetermined function, said function comprising a first portion (I) at high engine rpms beginning at and adjacent maximum engine power and extending toward the maximum engine operating RPM said first portion maintaining the effective area substantially in its maximum area condition as established by peak engine operating pressures and a second portion (II) at lower engine rpms beginning adjacent or below peak engine torque and extending toward the minimum engine operating rpm, said second portion maintaining the effective area substantially in the minimum area condition and a third portion (III) intermediate the first and second portions and having a characteristic that the effective area increases as a direct function of engine rpm; means for generating a signal as a proportional function of engine rpm and applying said signal to said control means, means for generating a feedback signal representing the actual effective area and feeding said signal back to said control means, said control means being responsive to the rpm signal generating means and to the feedback signal generating means to generate signals applied to said actuator means to correct the actuating means for varying the effective area of the turbine solely as a predetermined function of engine rpm over said third portion (III).

2. Apparatus as claimed in claim 1 wherein the minimum effective area is approximately 40% of the maximum.

3. Apparatus as claimed in claim 1 wherein said actuator comprises:

a displaceable shaft for connection with said means for varying the effective area of the turbine;

means connected to said shaft for defining a variable volume chamber connected to said control means receiving pressure signals from said control means and displacing said shaft;

means for yieldably urging said shaft in a direction to reduce the variable volume chamber whereby displacement of said shaft is a direct function of fluid pressure.

4. Apparatus as claimed in claim 3 wherein said yieldable urging means comprises a spring having a linear force/displacement characteristic;

said feedback means comprises a pressure transducer connected to said variable volume chamber means for producing a pressure signal directly proportional to the displacement of said shaft.

5. Apparatus as claimed in claim 1 wherein said control means comprises:

a solenoid valve for supplying fluid to said actuator at a controlled pressure;

an electrical controller for supplying electrical signals to said solenoid valve, and said rpm signal means generating a signal usable by said electrical controller.

6. Apparatus as claimed in claim 5 wherein said solenoid valve is an on/off valve and the electrical controller is adapted to generate pulse signals to said valve to regulate the pressure.

7. Apparatus as claimed in claim 3 wherein means are provided in said actuator to continuously bleed fluid from said variable volume chamber whereby said fluid acts to cool said actuator.

* * * * *